US006910336B2

(12) United States Patent
Sullivan et al.

(10) Patent No.: US 6,910,336 B2
(45) Date of Patent: Jun. 28, 2005

(54) COMBUSTION LINER CAP ASSEMBLY ATTACHMENT AND SEALING SYSTEM

(75) Inventors: Daniel J. Sullivan, Palm Beach Gardens, FL (US); Shawn Miller, Palm City, FL (US); Miguel A. Garrido, Palm Beach Gardens, FL (US); Vincent C. Martling, Jupiter, FL (US)

(73) Assignee: Power Systems Mfg. LLC, Jupiter, FL (US)

( * ) Notice: Subject to any disclaimer, the term of this patent is extended or adjusted under 35 U.S.C. 154(b) by 154 days.

(21) Appl. No.: 10/368,754

(22) Filed: Feb. 18, 2003

(65) Prior Publication Data

US 2004/0159107 A1 Aug. 19, 2004

(51) Int. Cl.[7] ..... F22R 3/46
(52) U.S. Cl. ..... 60/798; 60/39.37
(58) Field of Search ..... 60/796, 798, 800, 60/39.37, 747

(56) References Cited

U.S. PATENT DOCUMENTS 3,811,274 A * 5/1974 Calderon ..... 60/800
5,329,772 A 7/1994 Fitts et al.
5,357,745 A 10/1994 Probert
5,423,368 A 6/1995 Fitts et al.

* cited by examiner

*Primary Examiner*—Ehud Gartenberg
(74) *Attorney, Agent, or Firm*—Brian R. Mack

(57) ABSTRACT

An attachment and sealing system for securing a combustor cap assembly to a combustion chamber, while providing effective cooling to the combustor cap assembly aft end, is disclosed. The combustor cap assembly is secured within a combustion chamber by a plurality of pins such that the aft end region of the combustor cap assembly is cooled by a fluid medium that is injected through a plurality of first holes in the combustion chamber wall. A generally annular seal, which encompasses the combustor cap assembly, has a plurality of raised ridges, which are in sealing contact with the combustion chamber wall. Multiple embodiments are disclosed regarding the length of the generally annular seal and position and orientation of the plurality of first cooling holes in the combustion chamber wall.

19 Claims, 4 Drawing Sheets

COMBUSTION LINER CAP ASSEMBLY ATTACHMENT AND SEALING SYSTEM

BACKGROUND OF THE INVENTION

1. Field of the Invention

This invention relates to gas turbine combustors, and more specifically to the interface between a cap assembly and combustion chamber.

2. Description of Related Art

Gas turbine combustors typically contain at least one combustion chamber with the products of combustion directed through the aft end of the combustion chamber and into a turbine. Typically, the combustion chamber is enclosed at its forward end by a cap assembly. The cap assembly is used to deliver fuel and air from the fuel nozzles to the combustion chamber. The current cap assembly that is used in many multi-nozzle combustion chambers, which is shown in cross section in FIG. 1, has a single region for sealing the cap assembly to the combustion chamber. Cap assembly 10 contains an outer band 11 having a sealing region 12 for sealing cap assembly 10 to combustion chamber wall 13 while also fixed to wall 13 by pins 19. Depending on manufacturing tolerances and operating conditions this seal can become ineffective, resulting in an undesirable leakage of compressed air into combustion chamber 16. This leakage can alter the fuel/air ratio within combustion chamber 16, thereby affecting flame stability, and the introduction of unmixed air can adversely affect combustor emissions. Furthermore, cap assembly 10 includes an impingement plate 14 that is fixed to outer band 11 at cap assembly aft end 17 resulting in a thick and rigid joint region 15 that is directly exposed to radiation from combustion chamber 16. Although a cooling medium is permitted to flow through mixing holes 22 of impingement plate 14 and cooling holes 18, there are no holes directing a cooling medium towards joint region 15. As a result, joint region 15 can be exposed to elevated temperatures for extended periods of time, leading to premature degradation of cap assembly aft end 17.

SUMMARY AND OBJECTS OF THE INVENTION

The present invention seeks to overcome the shortfalls of the prior art by providing a cap assembly for a combustion chamber with an improved sealing system and improved cooling effectiveness proximate the combustor cap assembly aft end. In accordance with the preferred embodiment of the present invention, a cap assembly is provided that contains a generally annular seal having a plurality of raised ridges that extend radially outward and are in sealing contact with a surrounding combustion chamber wall. Utilizing a plurality of raised ridges as seals, as opposed to a single seal of the prior art, creates a more effective seal against undesirable cooling medium entering the combustion chamber. Multiple seals provide resiliency should a single seal leak due to manufacturing tolerances, damage during installation, or operating conditions. Also, having multiple seals creates a more difficult path for a cooling medium to overcome in order to enter the combustion chamber. Furthermore, having a plurality of raised ridges provides increased surface area for positioning the cap assembly within a combustion chamber. Fixed to and radially within the generally annular seal is a generally annular wall that serves as a structural support member for the cap assembly. Fixed to the generally annular wall and located radially within the generally annular seal is a generally annular dome plate that contains a plurality of openings as well as a plurality of cooling holes. Each of the plurality of openings contains a nozzle tube for receiving a fuel nozzle.

The cap assembly is installed within a combustion chamber wall such that the raised ridges are in sealing contact with the combustion chamber wall. A plurality of pins are utilized to position the cap assembly in place within the combustion chamber. In order to provide adequate cooling at the combustor cap assembly aft end, where the dome plate and generally annular wall are joined together, proximate the generally annular seal, the combustion chamber wall contains a plurality of cooling holes that direct a cooling medium to this joint region. With regards to combustor flame stability and emissions, it is advantageous to have a resilient sealing system in combination with controlled amounts of cooling medium injected at a desired location, as opposed to a poor sealing system that could allow an unknown amount of air dedicated for combustion mixing to leak into the system.

It is an object of the present invention to provide an improved sealing system between a cap assembly and a combustion chamber.

It is a further object of the present invention to provide improved cooling to the combustor cap assembly aft end through a plurality of strategically placed cooling holes in the combustion chamber wall.

In accordance with these and other objects, which will become apparent hereinafter, the instant invention will now be described with particular reference to the accompanying drawings.

DETAILED DESCRIPTION OF THE PREFERRED EMBODIMENT

Figure 1:
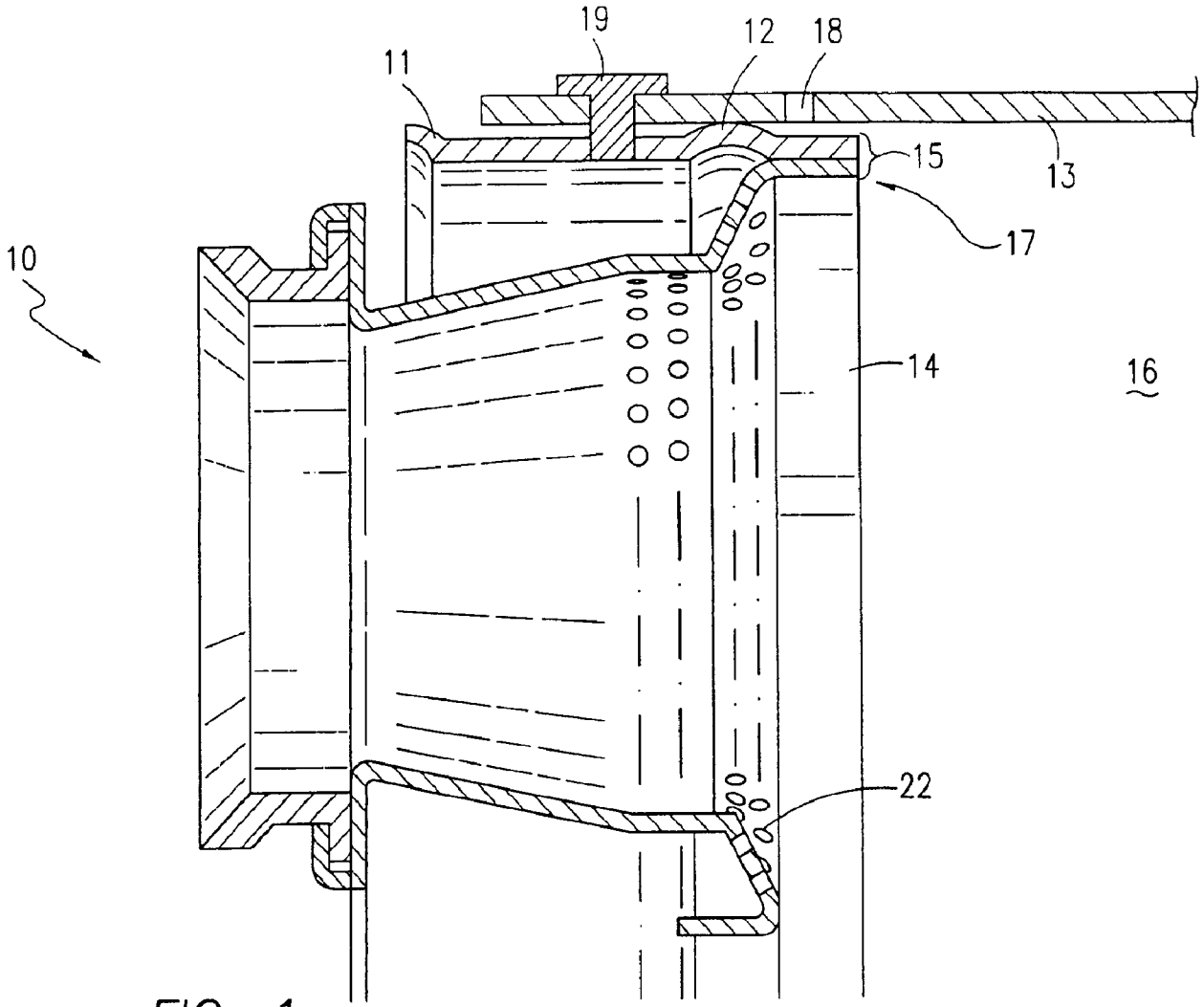
FIG. 1 PRIOR ART
FIG. 1 is a partial cross section of a cap assembly of the prior art.
Figure 2:
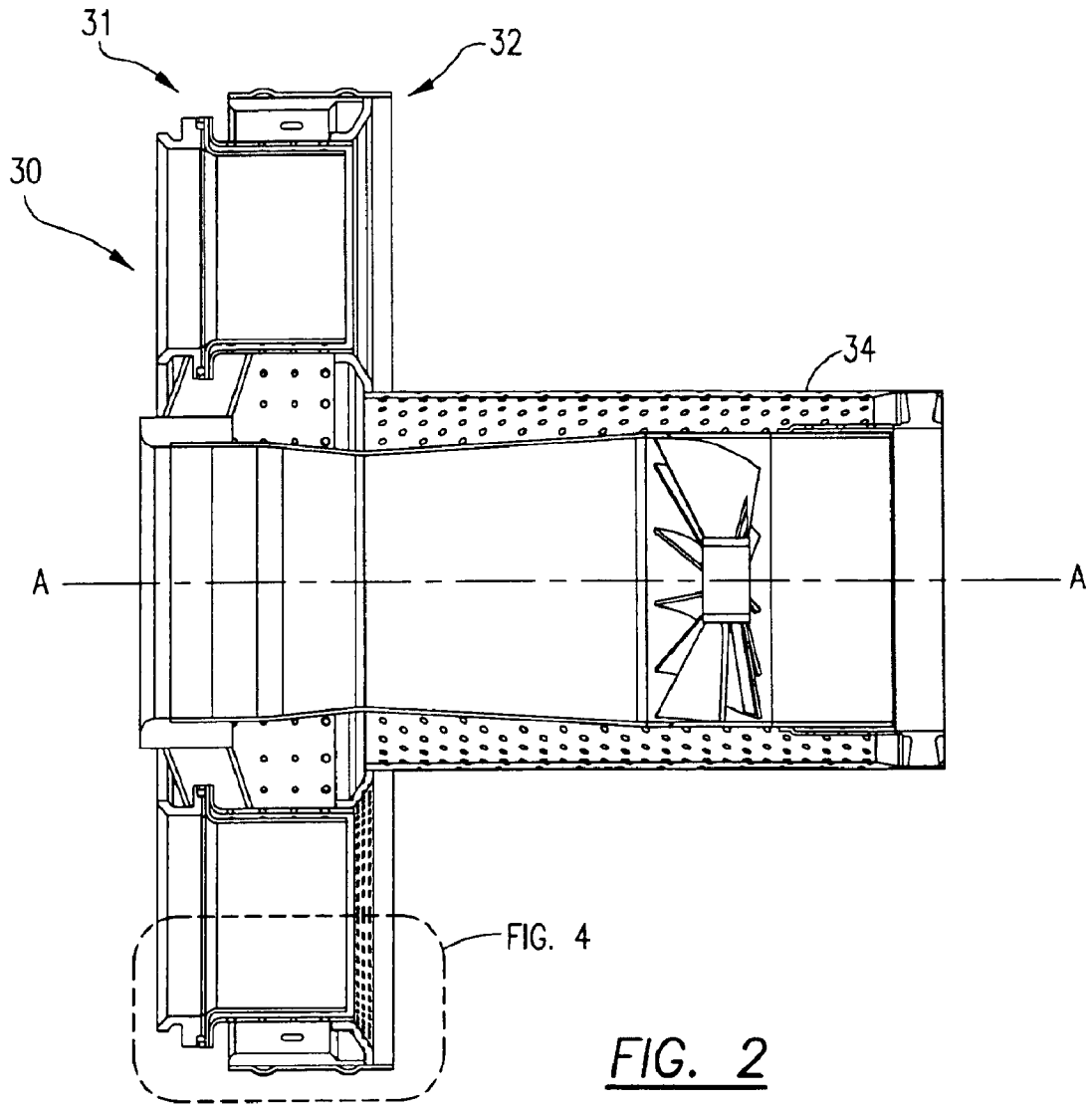
FIG. 2 is a cross section of the cap assembly that utilizes the present invention.
Figure 3:
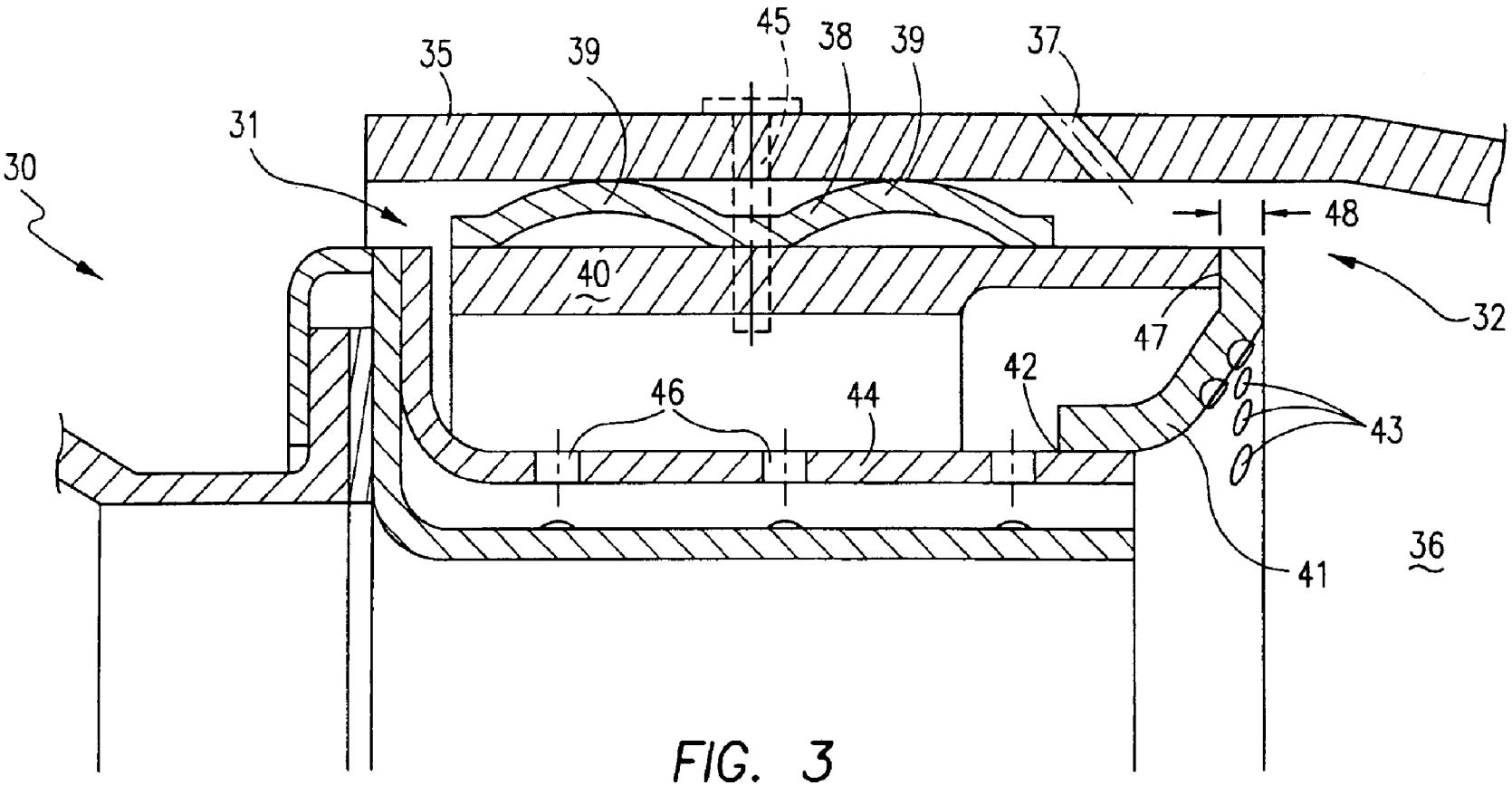
FIG. 3 is a partial cross section of a cap assembly installed in a combustion chamber in accordance with the present invention.
Figure 4:
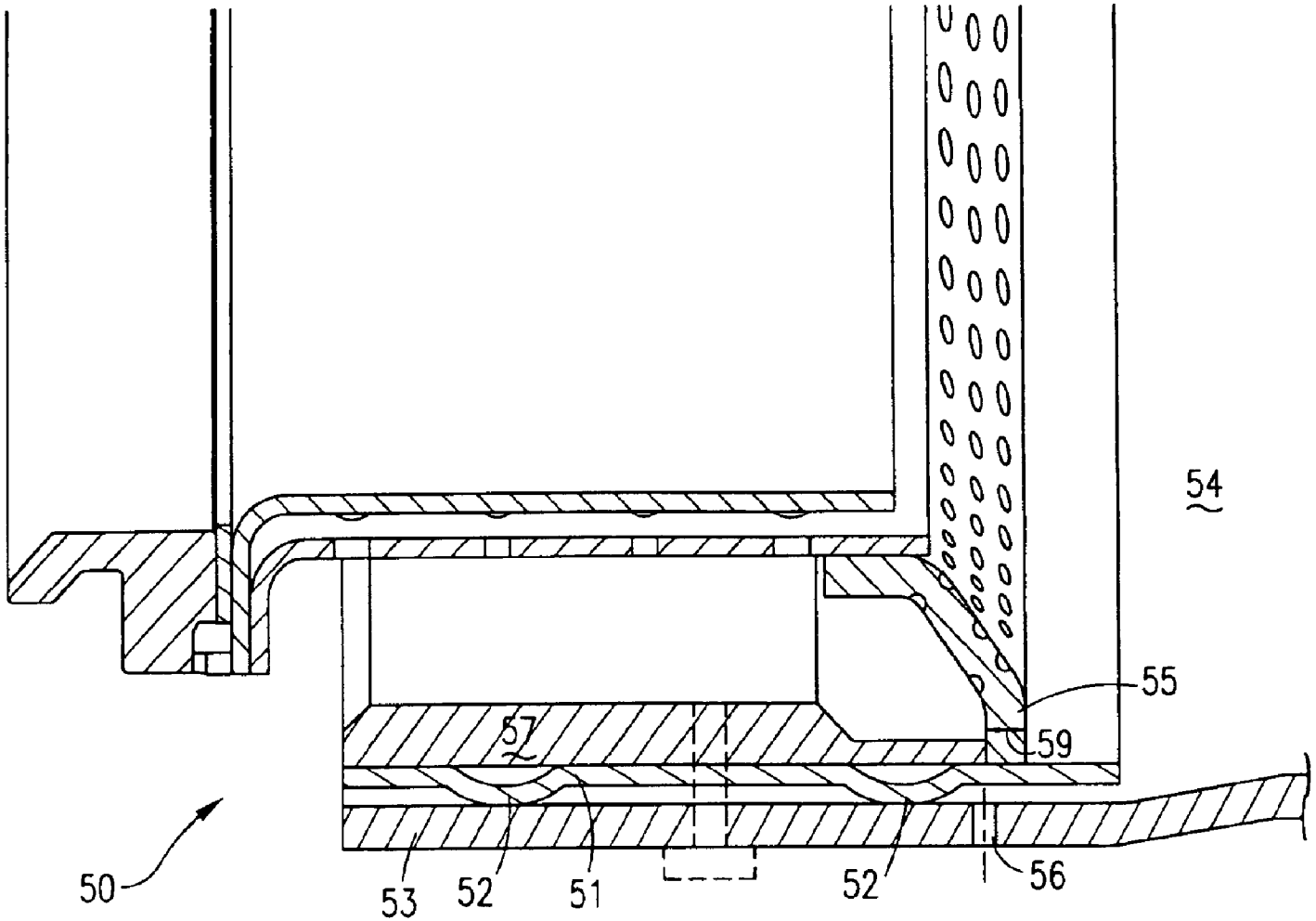
FIG. 4 is a partial cross section of a cap assembly installed in a combustion chamber in accordance with an alternate embodiment of the present invention.

The present invention, an attachment and sealing system for securing a combustor cap assembly to a combustion chamber, is shown in detail in the accompanying FIGS. 2–4. Referring to FIG. 2, a combustor cap assembly 30 incorporating an embodiment of the present invention is shown in cross section. Combustor cap assembly 30 has a forward end 31, an aft end 32, and a center axis A—A. Depending on the type of combustor in which cap assembly 30 is utilized, an optional centerbody 34 may extend from aft end 32 for directing additional air and fuel into the combustor. The preferred embodiment of the attachment and sealing system between combustor cap assembly 30 and a combustion chamber is shown in greater detail in FIG. 3.

In the preferred embodiment of the present invention, combustor cap assembly 30 is located radially within a first generally annular wall 35 of combustion chamber 36. A plurality of first cooling holes 37 are located about first generally annular wall 35 and inject a cooling medium from outside of combustion chamber 36. Combustor cap assembly 30 also includes a generally annular seal 38 having a plurality of raised ridges 39 that are continuous about generally annular seal 38 and extend radially outward and are in sealing contact with first generally annular wall 35. In order to increase the sealing effectiveness of this type of seal, it has been determined that a plurality of raised ridges, preferably two, are optimal. Therefore, should one of the ridges not seal completely due to manufacturing tolerances or excessive wear, an additional seal is present. Fixed to and radially within generally annular seal 38 is a second generally annular wall 40 which primarily serves as structural support for cap assembly 30. A generally annular dome plate 41 is fixed to second generally annular wall 40 at joint region 47 and is also located radially within generally annular seal 38. Joint region 47 is separated from combustion chamber 36 by dome plate thickness 48 in order to protect it from radiation effects from combustion chamber 36. Generally annular dome plate 41 has a plurality of openings 42 located about center axis A—A as well as a plurality of second cooling holes 43. Second cooling holes 43 provide a large amount of the air to combustor 36 as well as serve to cool dome plate 41 from the heat generated by combustion immediately adjacent in combustor 36. As a result of the amount of cooling required for the entire dome plate 41, versus the cap assembly aft end 32, the plurality of second cooling holes 43 outnumber the plurality of first cooling holes 37 about first generally annular wall 35. Fixed to openings 42 in dome plate 41 is a plurality of nozzle tubes 44 each of which receive a fuel nozzle for injecting fuel and air into combustor 36. In the preferred embodiment, nozzle tubes 44 are telescopically received within openings 42 of dome plate 41. Typically, due to the operating temperature of cap assembly 30, it is also necessary to cool at least one of nozzle tubes 44 through a plurality of third cooling holes 46. Once combustor cap assembly 30 is installed in first generally annular wall 35 of combustion chamber 36, a plurality of pins 45 are installed to secure cap assembly 30 in place. Pins 45 extend from radially outward of combustion chamber 36, through first generally annular wall 35, through generally annular seal 38, and through second generally annular wall 40. It is preferred that pins 45 are placed axially between raised ridges 39, such that they do not adversely affect the seal that is created when raised ridges 39 are in contact with first generally annular wall 35. In order to provide sufficient support of combustor cap assembly 30 against the mechanical and aerodynamic loads of combustion chamber 36, plurality of pins 45 comprises at least five pins.

Referring back to first cooling holes 37, they are positioned relative to combustor cap assembly 30 such that they inject a cooling medium proximate cap assembly aft end 32, generally towards combustion chamber 36. The addition of cooling holes at this location is critical for cap assembly cooling. Due to manufacturing and assembly requirements, it is not feasible to add additional second cooling holes 43 immediately adjacent joint region 47. If this region were directly exposed to elevated temperatures, with minimal cooling, degredation of cap assembly aft end 32 would occur, as with the prior art. Therefore, it is desirable, in the preferred embodiment, to position first cooling holes 37 such that they direct a cooling medium towards joint region 47, such that not only is aft end 32 cooled by impingement cooling, but the cooling medium then creates a film layer along first generally annular wall 35 as it enters combustion chamber 36. Although a variety of cooling mediums could be used to cool cap assembly 30 and inject into combustion chamber 36, it is preferred that the cooling medium is either compressed air or steam.

An alternate embodiment of the present invention is shown in partial cross section in FIG. 4. The alternate embodiment of the present invention is nearly identical to the preferred embodiment with the exception of the length of the generally annular seal and orientation of the plurality of first cooling holes, therefore only the components affected by these changes will be described in detail. In this alternate configuration, combustor cap assembly 50 has a generally annular seal 51 with a plurality of raised ridges 52 that are in scaling contact with first generally annular wall 53 of combustion chamber 54. Unlike the preferred embodiment, generally annular seal 51 extends beyond dome plate 55. The longer length of generally annular seal 51 allows the cooling medium injected through first cooling holes 56 to impinge on generally annular seal 51 at joint region 58. As with the preferred embodiment, joint region 58 is separated from combustion chamber 54 by dome plate thickness 59 to protect joint region 58 from the radiation effects of combustion chamber 54. Furthermore, the plurality of first cooling holes 56 can be oriented perpendicular to first generally annular wall 53 to provide a more effective impingement cooling and film layer along first generally annular wall 53 after cooling joint region 58.

While the invention has been described in what is known as presently the preferred embodiment, it is to be understood that the invention is not to be limited to the disclosed embodiment but, on the contrary, is intended to cover various modifications and equivalent arrangements within the scope of the following claims.

We claim:

1. An attachment and sealing system for securing a combustor cap assembly to a combustion chamber, said attachment and sealing system comprising:

a combustion chamber having a first generally annular wall and a plurality of first cooling holes located about said first generally annular wall;

a combustor cap assembly having a forward end, an aft end, and a center axis, said combustor cap assembly located radially within said first generally annular wall, and comprising:

a generally annular seal having a plurality of raised ridges extending radially outward and in sealing contact with said first generally annular wall;

a second generally annular wall fixed to and radially within said generally annular seal;

a generally annular dome plate having a thickness, a plurality of openings located about said center axis, and a plurality of second cooling holes, said dome plate fixed to said second generally annular wall at a joint region and located radially within said generally annular seal;

a plurality of nozzle tubes, said nozzle tubes fixed to said dome plate at said plurality of openings, for receiving a plurality of fuel nozzles;

a plurality of pins extending from radially outward of said combustion chamber, through said first generally annular wall, through said generally annular seal, and through said second generally annular wall such that said cap assembly is fixed to said combustion chamber;

wherein said plurality of first cooling holes are located proximate said cap assembly aft end in order to direct a cooling medium towards said joint region.

2. The attachment and sealing system of claim 1 wherein said plurality of raised ridges are continuous about said generally annular seal.

3. The attachment and sealing system of claim 2 wherein said plurality of raised ridges comprises two ridges.

4. The attachment and scaling system of claim 3 wherein said plurality of pins are located between said raised ridges.

5. The attachment and sealing system of claim 1 wherein said nozzle tubes are telescopically received within said openings of said dome plate.

6. The attachment and sealing system of claim 5 wherein at least one of said nozzle tubes contains a plurality of third cooling holes.

7. The attachment and sealing system of claim 1 wherein said plurality of second cooling holes outnumber said plurality of first cooling holes.

8. The attachment and sealing system of claim 1 wherein said plurality of pins comprises at least five pins.

9. The attachment and sealing system of claim 1 wherein said cooling medium is either air or steam.

10. The attachment and sealing system of claim 1 wherein said joint region is separated from said combustion chamber by said thickness of said domeplate.

11. An attachment and sealing system for securing a combustor cap assembly to a combustion chamber, said attachment and sealing system comprising:

a combustion chamber having a first generally annular wall and a plurality of first cooling holes located about said first generally annular wall;

a combustor cap assembly having a forward end, an aft end, and a center axis, said combustor cap assembly located radially within said first generally annular wall, and comprising:

a generally annular seal having a plurality of raised ridges extending radially outward and in sealing contact with said first generally annular wall;

a second generally annular wall fixed to and radially within said generally annular seal;

a generally annular dome plate having a thickness, a plurality of openings located about said center axis, and a plurality of second cooling holes, said dome plate fixed to said second generally annular wall at a joint region and located radially within said generally annular seal;

a plurality of nozzle tubes, said nozzle tubes fixed to said dome plate at said plurality of openings, for receiving a plurality of fuel nozzles, wherein at least one of said nozzle tubes contains a plurality of third cooling holes;

a plurality of pins extending from radially outward of said combustion chamber, through said first generally annular wall, through said generally annular seal, and through said second generally annular wall such that said cap assembly is fixed to said combustion chamber;

wherein said plurality of first cooling holes are located proximate said cap assembly aft end in order to direct a cooling medium towards said joint region.

12. The attachment and sealing system of claim 11 wherein said plurality of raised ridges are continuous about said generally annular seal.

13. The attachment and scaling system of claim 12 wherein said plurality of raised ridges comprises two ridges.

14. The attachment and sealing system of claim 13 wherein said plurality of pins are located between said raised ridges.

15. The attachment and scaling system of claim 11 wherein said nozzle tubes are telescopically received within said openings of said dome plate.

16. The attachment and sealing system of claim 11 wherein said plurality of second cooling holes outnumber said plurality of first cooling holes.

17. The attachment and sealing system of claim 11 wherein said plurality of pins comprises at least five pins.

18. The attachment and sealing system of claim 11 wherein said cooling medium is either air or steam.

19. The attachment and sealing system of claim 11 wherein said joint region is separated from said combustion chamber by said thickness of said domeplate.

* * * * *